US006113223A

United States Patent [19]

Tanaka et al.

[11] Patent Number: 6,113,223

[45] **Date of Patent: *Sep. 5, 2000**

[54] INK JET RECORDING HEAD WITH INK CHAMBER HAVING SLANTED SURFACES TO AID BUBBLE REMOVAL

[75] Inventors: Shigeaki Tanaka, Kawasaki; Nobuyuki Kuwabara, Tokyo; Akira Goto; Takashi Watanabe, both of Yokohama; Kunihiko Maeoka; Masaaki Izumida, both of Kawasaki; Koichi Sato; Tsuguhiro Fukuda, both of Yokohama; Hiroshi Sugitani, Machida; Yoshifumi Hattori, Yamato; Masami Ikeda, Tokyo; Asao Saito, Yokohama; Kazuaki Masuda, Sagamihara; Akio Saito, Hadano; Tsuyoshi Orikasa, Kasukabe; Takashi Ohba, Zama; Hiroshi Nakagomi, Yamato; Teruo Arashima; Jun Kawai, both of Yokohama; Tsutomu Abe, Isehara; Toshio Kashino, Chigasaki; Makiko Kimura, Sagamihara; Hideo Saikawa, Kawasaki; Seiichiro Karita, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/801,422

[22] Filed: Feb. 18, 1997

Related U.S. Application Data

[63] Continuation of application No. 08/016,199, Feb. 11, 1993, abandoned, which is a continuation of application No. 07/798,981, Nov. 29, 1991, abandoned, which is a continuation of application No. 07/583,238, Sep. 17, 1990, abandoned.

[30] Foreign Application Priority Data

Sep. 22, 1989 [JP] Japan ..... 1-247766

[51] Int. Cl.[7] ..... B41J 2/05

[52] U.S. Cl. ..... 347/65; 347/30; 347/92

[58] Field of Search ..... 347/65, 63, 92, 347/30

[56] References Cited

U.S. PATENT DOCUMENTS

| | | | |
|---|---|---|---|
| 4,216,477 | 8/1980 | Matsuda | 347/70 |
| 4,313,124 | 1/1982 | Hara | 347/57 |

(List continued on next page.)

FOREIGN PATENT DOCUMENTS

| | | | |
|---|---|---|---|
| 0245002 | 11/1987 | European Pat. Off. . | |
| 54-56847 | 5/1979 | Japan . | |
| 128465 | 10/1980 | Japan | B41J 3/04 |
| 59-123670 | 7/1984 | Japan . | |
| 59-138461 | 8/1984 | Japan . | |
| 60-71260 | 4/1985 | Japan . | |
| 2104452 | 3/1983 | United Kingdom . | |

*Primary Examiner*—Joseph W. Hartary
*Assistant Examiner*—Craig A. Hallacher
*Attorney, Agent, or Firm*—Fitzpatrick, Cella, Harper & Scinto

[57] ABSTRACT

An ink jet recording apparatus includes a liquid passage for ejection of ink; a liquid chamber for supplying ink to the passage; a device for mounting the recording head on the ink jet recording apparatus at an angle not more than 45 degrees relative to the horizontal plane; wherein the chamber has an internal surface which is slanted in a direction from an ink inlet thereof toward the liquid passage at the angle of 5–40 degrees relative to an extension of the liquid passage.

30 Claims, 9 Drawing Sheets

U.S. PATENT DOCUMENTS

| | | | |
|---|---|---|---|
| 4,345,262 | 8/1982 | Shirato et al. | 347/10 |
| 4,383,263 | 5/1983 | Ozawa | 347/30 |
| 4,424,521 | 1/1984 | Lewis | 347/92 X |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,589,000 | 5/1986 | Koto | 347/92 X |
| 4,638,337 | 1/1987 | Torpey | 347/65 |
| 4,703,332 | 10/1987 | Crotti | 347/87 |
| 4,712,172 | 12/1987 | Kiyohara | 347/87 X |
| 4,723,129 | 2/1988 | Endo et al. | 347/56 |
| 4,740,796 | 4/1988 | Endo et al. | 347/56 |
| 4,752,787 | 6/1988 | Matsumoto | 347/65 |
| 4,774,530 | 9/1988 | Hawkins | 347/63 |
| 4,779,099 | 10/1988 | Lewis | 347/20 |
| 4,797,692 | 1/1989 | Ims | 347/56 X |
| 4,922,269 | 5/1990 | Ikeda | 347/58 X |
| 4,947,191 | 8/1990 | Nozawa | 347/30 |
| 5,867,195 | 2/1999 | Kakeno | 347/92 |

INK JET RECORDING HEAD WITH INK CHAMBER HAVING SLANTED SURFACES TO AID BUBBLE REMOVAL

This application is a continuation of application Ser. No. 08/016,199, filed Feb. 11, 1993, now abandoned, which was a continuation of application Ser. No. 07/798.981, filed Nov. 29, 1991, now abandoned, which in turn is a continuation of application Ser. No. 07/583,238, filed Sep. 17, 1990, now abandoned.

FIELD OF THE INVENTION AND RELATED ART

The present invention relates to an ink jet recording head, a detachably mountable ink jet recording unit or cartridge and an ink jet recording apparatus usable with the recording head or the recording unit, which comprises an energy generating element for generating energy contributable to eject ink, an ink passage communicating with an ink ejection outlet and a liquid chamber for supplying the ink to the passage.

Known ink jet recording apparatus, recording head and recording unit having an integral ink container, include a type in which fine droplets of liquid are ejected, a type wherein an electrode is used to deflect the liquid droplet and a type wherein heat is generated by a heat generating element disposed in a liquid passage to produce a bubble by which a droplet of liquid is ejected through the ejection outlet.

Among those types, the ink jet recording head using thermal energy to eject the recording liquid is particularly noted because the recording density can be easily increased, because mass-production is easily accomplished and because the manufacturing cost is not high. These benefits result from the features that liquid jet recording outlets such as orifices or the like for ejecting the recording liquid (ink) droplets can be arranged at a high density so that a high resolution printing is possible, and that the entire size of the recording head can be easily reduced. In the recording head ink is supplied from an ink container, or the recording head is in the form of a unit including the integral ink container. In such a recording head, it is preferable that the liquid chamber or the ink passage not contain unnecessary bubbles. Particularly when the volume of an unnecessary bubble increases, it functions as a buffer against the ejection pressure or impedes the flow of the liquid with the result of improper recording. In addition, the bubble or bubbles have a heat insulation effect with the result that abnormally high temperatures can occur to such an extent that the electrothermal transducer loses its function. In order to avoid such problems, various recovery means are proposed. They include means for sucking the unnecessary bubbles through the ejection outlet of the head or means for removing the bubbles together with the ink supplied from the ejection outlet, such means being operated upon occurrence of the improper recording or at intervals determined on the basis of prediction. With the use of such recovery means, the number of recovery operations performed is increased to remove the unnecessary bubbles. Otherwise, the amount of sucked liquid or the degree of the pressure applied is increased. However, they increase the interruption period or decrease the intervals between recovery operations because of incomplete recovery operation.

Another means is proposed by which the produced unnecessary bubbles are concentrated in a chamber communicating with the ambient atmosphere to spontaneously remove them. This results in bulky apparatus and recording head or unit, which in addition, are not usable with a closed type liquid chamber or liquid passage.

Experiments and investigations have revealed that a great change occurs in the liquid chamber of a conventional ink jet recording head after periods of non-use of one to three months. More particularly, a large bubble having a size of 400 microns appears in the liquid chamber. The cause thereof is not completely found. In any case, with the conventional ink jet recording head, such a large bubble can not be removed even when the above-described recovery means is operated. Therefore, the user has to exchange the recording head.

Further investigations and experiments have revealed that the unnecessary bubble appearing and developed in the liquid chamber of the recording head can not be completely removed from the inside of the liquid chamber, but remains in the form of bubbles having sizes of 50–100 microns.

The causes of the unnecessary bubble production are considered as being evaporation of the ink in the ink container, dissolved gas in the ink, remainder of the bubble produced upon ejection, significant retraction of the meniscus at the ejection outlet upon capping of the ejection outlets and bubbles introduced together with the fresh ink from the ink supply inlet. It is very difficult to accomplish the structure which prevents the ink leakage but allows air or gas to enter, and the inventors have investigated other ways to accomplish structure with which the large unnecessary bubble can be easily removed in a short period and with certainty. Then, the improper recording (instability of the position of the ink droplets deposited on the recording sheet, the instability of the size of the ejection ink droplet, improper ejection through a part of the orifices, shortage of the ink in the liquid chamber or the like) or the reduction of the service life of the energy generating element due to heating without ink (that is, in the presence of a bubble), can be prevented. Various experiments and investigations by the inventors have revealed that the effects of the conventional recovery means is not as expected because turbulent flow is produced with the result of dispersion of bubbles, thus remaining the cause of large size unnecessary bubble.

SUMMARY OF THE INVENTION

Accordingly, it is a principal object of the present invention to provide an ink jet recording head, a detachably mountable ink jet recording unit and an ink jet recording apparatus using such a head or unit in which the improper recording or the failure of the recording attributable to the unnecessary bubble or bubbles can be prevented beforehand.

It is another object of the present invention to provide an ink jet recording head, a detachably mountable ink jet recording unit and an ink jet recording apparatus using such a recording head or unit, wherein even if the unnecessary bubble or bubbles are produced in the liquid passage or liquid chamber, the same can be easily and effectively removed.

According to an aspect of the present invention, the liquid chamber for supply the ink to the ink passage has a slanted wall inclined by 5–40 degrees relative to an extension of the liquid passage, at least in a direction from an inlet of the ink chamber through which the ink is supplied into the liquid chamber to the ink passage.

The bubbles introduced into the liquid chamber can be concentrated, and therefore, the dispersed bubbles can be collected, and therefore, can be removed from a port. More particularly, the introduced bubbles are removed along the slanted wall through an outlet port. Thus, the improper printing and the reduction of the service life of the recording head attributable to the unnecessary bubble can be avoided. This effects are further enhanced by providing the slanted wall at the lateral sides.

Even more specifically, the liquid chamber has an internal surface which is slanted in a direction extending from an ink inlet toward the liquid passages at a converging angle of 5–40 degrees relative to an extension of the liquid passages, as seen in a direction in which the liquid passages are overlapped when seen in a side profile.

In addition, by making the slanting angle of the lateral walls larger than the inclination of the longitudinally slanted wall, the direction of the bubble discharge can be concentrated on a single plane, and therefore, it is desirable from the standpoint of further increasing the unnecessary bubble removal. When the ink jet recording head is mounted on the main assembly of the recording apparatus such that the direction of the array of the ejection energy generating elements is inclined relative to a horizontal plane by not more than 45 degrees upwardly or downwardly, the above-described slanted wall only is sufficiently in the situation in which the apparatus is left unused in a long term. When the recording unit is molded together with the ink container, the liquid chamber and the liquid supply member or the like, the manufacturing cost can be reduced, and therefore, it is preferable, but in this case, the gap permeability of the mold may influence the production of the unnecessary bubble, and therefore, the present invention can use be used advantageously to assure the further stabilized recording.

The structure having the longitudinally slanted wall and the lateral slanted walls, is particularly effective in the case of an ink jet recording unit which is detachably mountable to the main assembly of the recording apparatus. Without the present invention, such a recording unit involves the problems arising from vibration thereof, more particularly, the dispersion of the bubbles, or production of new bubbles. With the present invention, such vibration is rather preferable since it promotes concentration of the bubbles along the slanted surfaces, and therefore, promotes removal of the bubbles.

According to another aspect of the present invention, the recording apparatus comprises a carriage for carrying an ink jet recording head such that the direction of the array of the ejection energy generating means is inclined relative to the vertical direction by an angle of not more than 45 degrees, and the ink jet recording unit can be rotated relative to the movement direction of the carriage when the ink jet recording unit is mounted on the carriage. This is also preferable, because the above-described effect can be expected upon the mounting action or by the impact upon the reversal of the carriage.

According to another aspect of the present invention, the liquid chamber has a region continuing to the liquid passage and expanding toward the ink inlet thereto and a slanted surface toward the region, wherein an extension of the slanted surface extends to the ejection energy generating means disposed side of the liquid passage. In this aspect, the above-described angle is not limiting to this structure. By the provision of the expanding region, the small bubbles can be concentrated in this region. In addition, since the bubbles are retained away from an extension of the liquid passage provided with the energy generating means, and therefore, even if the bubbles are developed into a large bubble, the bubble is guided along the slanted surface away from the liquid passage, so that the occurrence of the improper recording can be significantly delayed. In addition, since the extension of the slanted surface abuts the surface of the passage on which the ejection energy generating means is disposed, the surface obstructs the bubble from entering the liquid passage even when some impact promotes the bubble approaching the liquid passage along the slanted surface.

Therefore, the large bubble does not enter the liquid passage. The angular limitations described in the foregoing are of course further preferable if combined with the feature of this aspect of the present invention.

According to another aspect of the present invention, which is particularly effective if used with sucking recovery operation, but which is also effective if used with the pressurizing recovery operation, the liquid passage has a trapezoidal cross-section with its base side having the energy generating means. This is effective because the conditions for dispersion of the unnecessary bubbles to the entire inside surfaces of the liquid passage is made non-uniform, so that the produced or introduced bubbles are concentrated to the short side of the trapezoidal passage. In addition, the discharging route of the bubbles upon recovery operation can be concentrated, and therefore, the bubble discharging effects can be further increased. In this case, the ejection outlet has a trapezoidal configuration corresponding to the trapezoidal liquid passage. The short side of the passage trapezoid corresponds to the short side of the ejection outlet trapezoid, and the same applies to the long size. Then, the turbulent or eddy flow of the ink upon recovery operation can be prevented, so that the bubble or bubbles can be stably discharged. The trapezoidal configuration is preferably symmetric.

According to a further aspect of the present invention, the liquid passage has a first region expanding in the symmetric trapezoidal configuration adjacent to the ejection outlets, and a second region connecting to the symmetric trapezoidal ejection outlet and converging toward it while maintaining the symmetric trapezoidal configuration. Therefore, the turbulent or eddy flow of the ink is hardly produced, so that the unnecessary bubbles can be assuredly removed.

According to a further aspect of the present invention, the first and second regions have symmetry about a plane formed by connecting centers of the lateral sides of the liquid passage trapezoidal, and therefore, the pressure distribution upon the recovery operation can be made uniform, so that the eddy flow production can be significantly reduced in the discharge region.

According to a further aspect of the present invention, there is provided a structure comprising a top plate having a recess for defining the liquid chamber and grooves for defining the liquid or ink passages and also having an integral portion in which ejection outlet is formed, and comprising a base plate on which said member is clamped by a clamping member applying a line pressure in the detection of the array of the liquid passages. With such a simple coupling structure, the above-described features of the liquid chamber are effective without the inconveniences due to the production of the unnecessary bubble These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
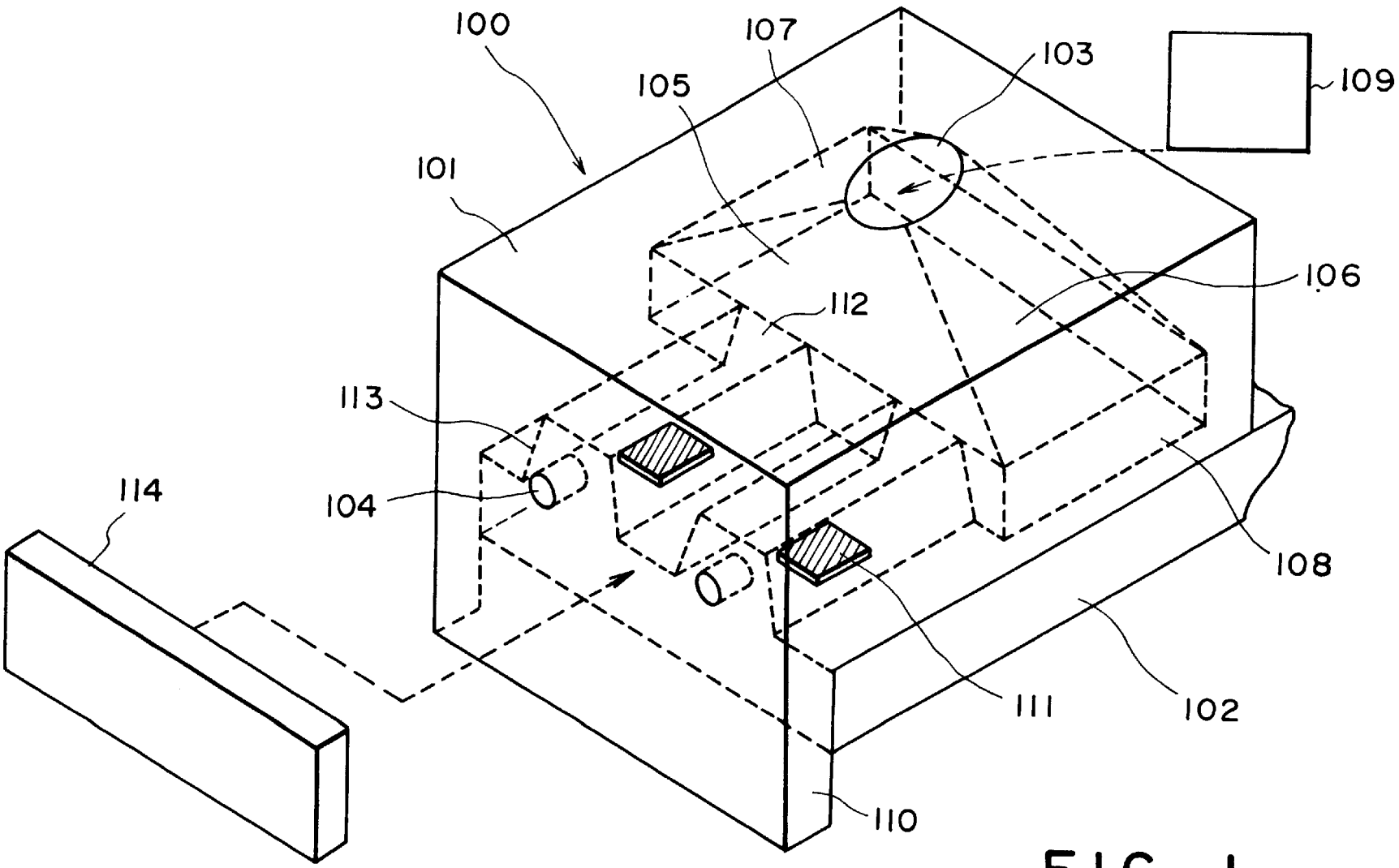
FIG. 1 is a perspective view of an ink jet recording device according to an embodiment of the present invention.

Referring to FIG. 1, there is shown an ink jet recording head according to an embodiment of the present invention. In this embodiment, an ink supply opening for supplying the ink to a common chamber is disposed at the top to supply the ink from the top. A slanted surface is provided at least on the inner wall of the common chamber at least from the supply opening to the liquid passage, or the slanted surface is not provided only in one direction from the ink supply opening toward the liquid passage but also provided on the lateral walls, by which even if the bubble is developed into a large bubble, or the like, the bubble can be easily removed from a discharge opening.

The unnecessary bubble moves along the internal wall and can be easily discharged through the discharging opening, by which the problems of improper printing and the reduction of service life attributable to the production of the bubble can be solved.

When the bubble is removed by pumping, the bubble can be easily removed.

The experiments show the relation between the angle of the slanted surface relative to an extension of the liquid passage and the amount of remaining unnecessary bubble. In the experiments, the bubbles were removed from the liquid chamber having the slanted wall by pumping, that is, a pump is used to suck the ink together with the bubble through the front side of the ejection outlets.

The ink supply opening is disposed at the top of the common chamber. The slanted surface extending therefrom toward the liquid passage is the longitudinal slant surface. The longitudinal slant angle is formed between the longitudinal slanted surface and the extension of the liquid passage. The lateral slanted surface extends laterally relative to the longitudinal slanted surface, and the slanting angle of the lateral slanting surface is formed between the lateral slanted surface and the extension of the bottom surface of the liquid passage. In the following description, three slanted surface structure means there are provided the longitudinal slanted surface and the two lateral slanted surface (the angle of slanted surfaces are the same), and one slanted surface structure means that there is provided only the longitudinal slanted surface.

TABLE 1

| Angle (degrees) | 90 | 45 | 40 | 35 | 30 | 20 |
|---|---|---|---|---|---|---|
| Three slanted surface structure | N | N | F | G | E | E |
| One slanted surface structure | N | N | F | F | G | G |

TABLE 2

| Angle (degrees) | 15 | 10 | 7 | 5 | 1 |
|---|---|---|---|---|---|
| Three slanted surface structure | E | E | G | G | N |
| One slanted surface structure | G | G | F | F | N |

E: The unnecessary bubbles were removed by one pumping action.
G: The unnecessary bubbles were removed by two pumping actions.
F: A slight amount of bubbles remained although the ejection failure did not occur.
N: The unnecessary bubbles were hardly removed.
Sucking pressure: −0.5 atm
Quantity of sucking: −0.05 cc (per one pumping action)

Figure 5:
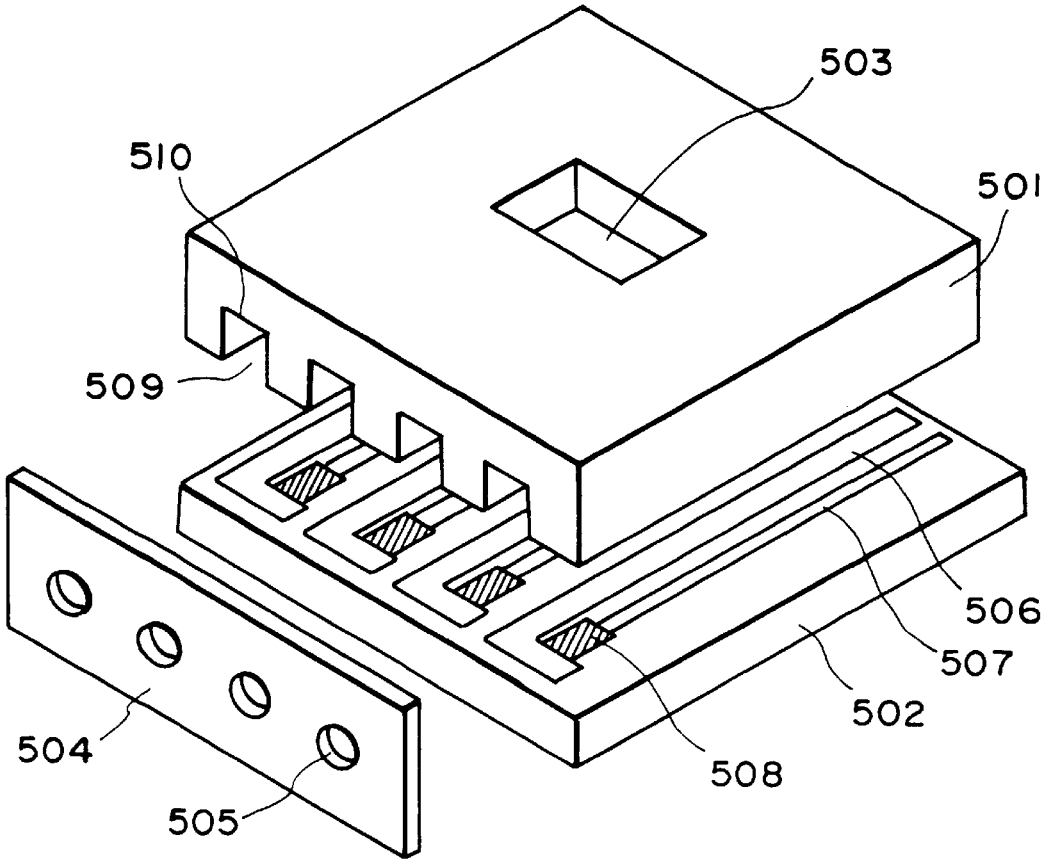
FIG. 5 PRIOR ART
FIG. 5 is a perspective view illustrating an example of a conventional ink jet recording head.

In the above Table, the angle 90 degrees correspond to the conventional structure shown in FIG. 5, that is, the common chamber is rectangular. In this Figure, the orifice plate is different from the orifice plate 110, 702 in FIG. 1 and FIG. 7. However, the results are the same (N). The orifice plate 110, the base plate 106 and the top plate 101 are separately manufactured, and thereafter, they are joined.

It is understood from the foregoing that the slanting angle is preferably not less than 5 degrees and not more than 40 degrees, further preferably not more than 35 degrees. In the embodiment described in the following, the slanting angle is 22 degrees.

Referring now to FIG. 1, there is shown an ink jet recording head according to an embodiment of the present invention. A top plate 101 has a plurality of recesses to define ink passages 112 when it is joined with a base plate 102. The base plate 102 is provided with the corresponding number of ejection energy generating elements 111 for generating energy contributable to the ejection of the liquid (ink).

The internal wall 105 of the common liquid chamber 108 from the ink supply opening (not shown) to the upstream end of the liquid passage 112, is slanted, and also the lateral internal walls 106 and 107 are also slanted. The angle of slant is 22 degrees as measured in the manner described above. The angles are determined such that the unnecessary bubble or bubbles having the diameter of 50–400 microns entering into the common chamber are easily removed. More particularly, the unnecessary bubble entering the chamber 108 is promptly moved along the walls 105, 106 and/or 107 and is discharged through a discharge opening 104. In addition, the unnecessary bubble is easily discharged by the pumping action. In this embodiment, the ink container 109 is separate from the recording head 100, and the ink is supplied by an unshown ink supply means to the ink receiving portion 103 of the common chamber 106. Designated by a reference numeral 114 is a known capping, sucking and recovery means.

Figure 6:
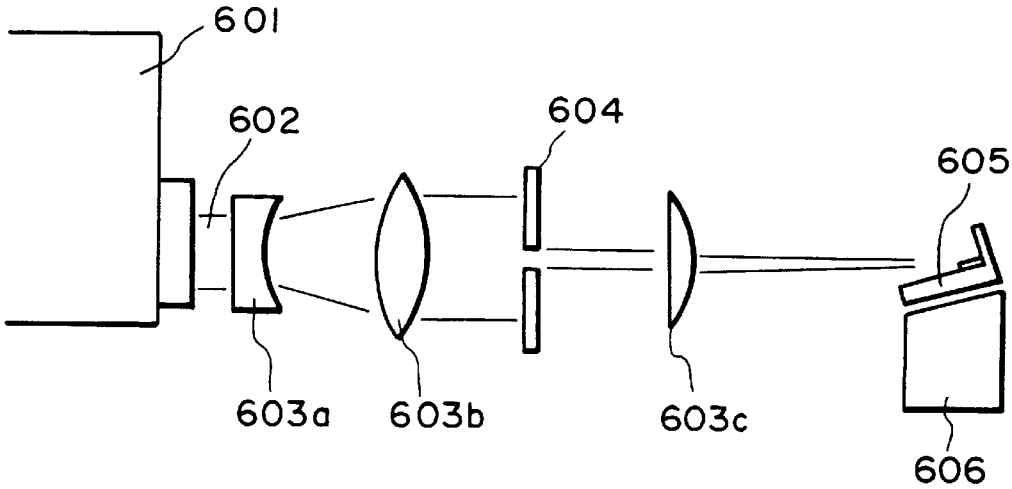
FIG. 6 illustrates the process of forming an orifice (ejection outlet) of the recording head.

In this embodiment, the orifice (ejection outlet) 104 of the recording head 100 can be formed by mechanical drilling using a micro-drilling machine or the like. In addition, the orifice or orifices can be formed by a laser oscillating ultraviolet light for example (excimer laser, 4-folded YAG laser) preferably. The process of using the ultraviolet laser beam will be described. A orifice plate in which the orifice or orifices are to be formed is mounted to the opening of the liquid passage, and thereafter, the ultraviolet laser is applied from the inside, that is, from the liquid passage side. FIG. 6 illustrates this. In this Figure, reference numeral 601 designates an ultraviolet laser oscillator; 602 designates a laser beam generated by the ultraviolet laser oscillator; 603*a*, 603*b* and 603*c* designate optical elements constituting a lens system; 604 designates a mask having all or part of the orifice patterns; 605 designates the main assembly of the ink jet recording head having the resin film at the openings of the ink passages; 606 designates a movable stage.

Figure 7:
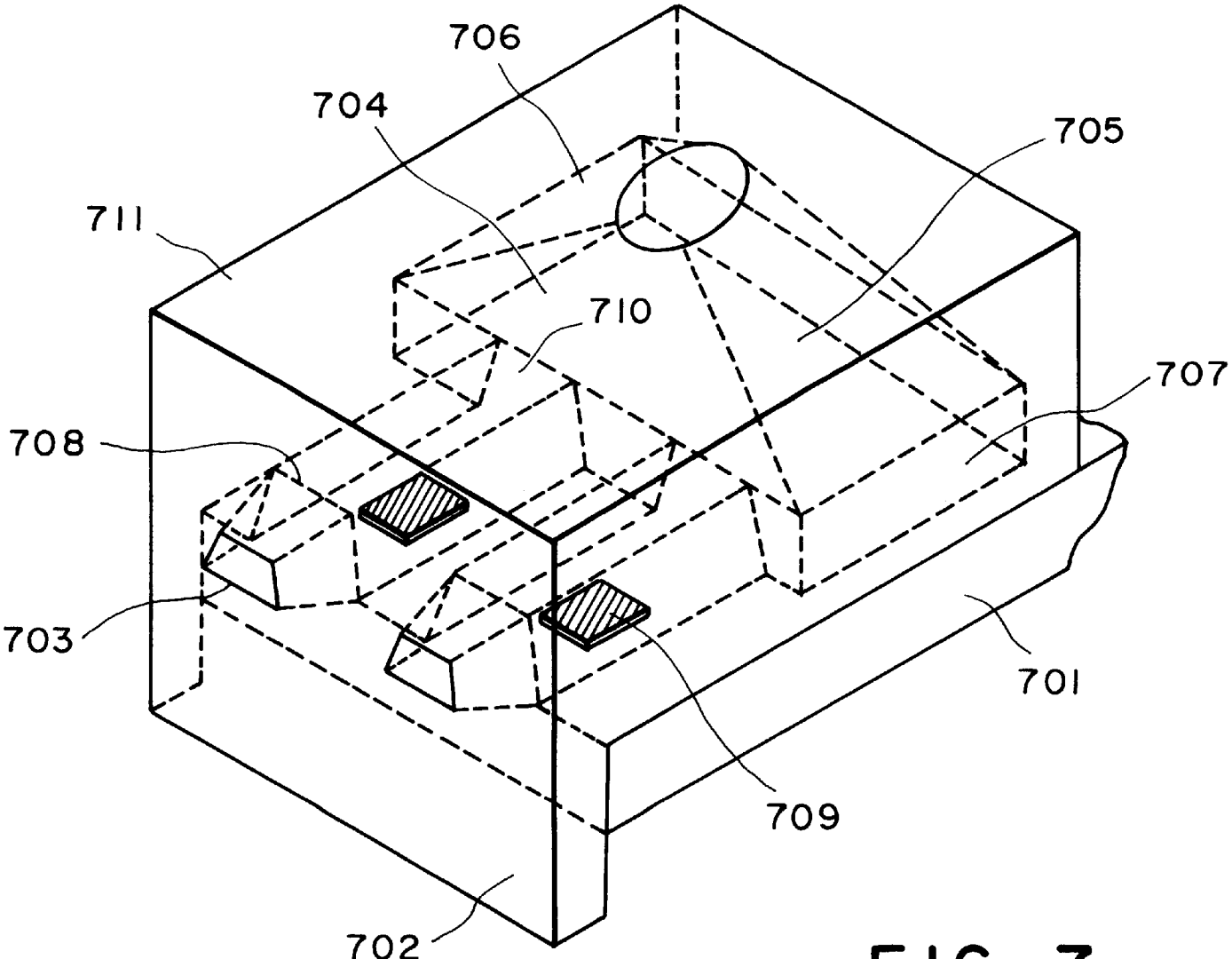
FIG. 7 is a perspective view of an ink jet recording device according to a further embodiment of the present invention.

FIGS. 1 and 7 show the details of the ink jet recording head in which the orifices are formed in this manner.

The top plate 101 or 711 shown in FIG. 1 or 7 is provided with ink passage grooves 113 or 708 and has an orifice plate 110 or 702 in which ink ejection outlets (orifices) 104 or 703. The number of them may be determined as desired, although two of them are shown for the sake of simplicity. The orifice plate 110, 702 is integrally molded with the top plate 101, 711.

In the structure of FIGS. 1 and 7, the top plate 101 and 711 is made of polysulfone or polyether sulfone, polyphenylene oxide, polypropylene or the like resin which exhibit good resistivity against ink. The orifice plate 110 or 702 is molded in the same mold simultaneously with the top plate 101 or 711.

The description will be made as to the formation of the ink passage grooves 113 and 708 and orifices 104 and 703.

The ink passage grooves 113 or 708 are molded using a mold having an opposite pattern produced by machining or the like. Using the mold, the fine grooves 113 or 708 can be formed on the top plate 101 or 711. The configuration thereof is such that it gradually expands toward the joining surface with the base plate.

As regards the formation of the orifices, the above-described molding is performed in the mold without the orifices 104 or 703. As shown in FIG. 6, an excimer laser beam is projected from the ink passage side to the orifice plate 110 or 702 at a position where the orifice is to be formed, by which the resin is removed or evaporated to provide the orifice 104 or 703.

Referring back to FIG. 6, the excimer laser beam 602 is projected to the orifice plate 110 or 702 from the ink passage 112 or 710 side through the mask 604, and is focused on the orifice plate 110 or 702. The excimer laser beam 602 is such that it converges with an angle of 2 degrees ($\theta 1$) at one side relative to the optical axis. The laser beam is produced at an angle of 5 or 10 degrees ($\theta 2$) relative to the direction perpendicular to the orifice plate 110 or 702.

The excimer laser beam will be described. The excimer laser oscillator is capable of oscillating ultraviolet light which has high energy, narrow wavelength band and high directivity with short pulse oscillation. By converging the laser beam by lens, the energy density is significantly made large.

The excimer laser oscillator causes discharge and excitation of a mixture of rare gas and halogen, by which short pulse ultraviolet light (15–35 ns) can be oscillated. Kr—F, Xc=Cl and Ar—F lasers are widely used. The oscillation energy thereof is several hundreds mJ/pulse, and the frequency of the pulses is 30–1000 Hz. When the high energy short pulse ultraviolet light such as excimer laser is projected to the polymer resin surface, the polymer resin is instantaneously dissolved and scattered with plasma light emission and with impact noise where the portion exposed thereto (ablative photodecomposition (APD)). By this, the polymer resin can be processed.

The comparison is made as to the machining accuracy between the excimer laser and the other laser. For example, a polyimide (PI) film is exposed to the excimer laser and YAG laser and $CO_2$ laser. The polyimide absorbs the light in the range of ultraviolet, and therefore, a sharp hole is formed by the KrF laser. Since the YAG laser does not produce the ultraviolet range light, it is possible to form a hole, but the edge is not smooth. The $CO_2$ laser generating an infrared light produced a hole, but a crater is produced around the hole.

The excimer laser beam can be blocked by metal such as stainless steel, non-transparent ceramic material or Si or the like in the atmospheric ambience, and therefore, these materials can be used for the mask.

The above-described heater board 102 or 701 and the top plate 101 or 711 are jointed, by which a recording head shown in FIG. 1 or 7 is provided.

As shown in these Figures, the heater board 102 or 701 having the ejection heaters 117 or 709 is abutted to the orifice plate 110 or 702, and is joined to provide the recording head.

In the structure described above, the alignment and bonding is not necessary between the top plate and the orifice plate, and therefore, the positional error in the alignment and the bonding operation can be avoided. This reduces the number of rejects and also reduces the number of manufacturing steps. Thus, this is contributable to the mass-production of the recording head and lowering its cost. In addition, there is no bonding step between the top plate and the orifice plate, the orifices 104 or 703 and the ink passages 112 or 710 are free from the liability of clogging by the bonding material. When the heater board 102 or 701 is joined with the top plate 101 or 711 having the orifice plate 110 or 702, the heater board 102 or 701 can be positioned in the direction of the flow of the ink 112 or 710 by abutting the heater board 102 or 701 to an end surface which is opposite from the discharge side end surface of the orifice plate 110 or 702, and therefore, the entire positioning step or the assembling steps are made easier. In addition, the orifice plate is not easily separated as in the conventional recording head.

The printing operation was performed using the recording head shown in FIG. 1 and FIG. 7. The accuracy of the position of the ejected droplet ink on the recording sheet is remarkably improved as compared with the conventional example of FIG. 5, and good recording result can be provided. In addition, the volume of the droplet of the ink was good and sufficient with good result of printing density.

In the embodiments of FIG. 1 and FIG. 7, the orifice plate is integral with the top plate. However, the present invention is not limited to this, but is applicable to a separate orifice plate is bonded to the top plate, and thereafter, the orifices are formed.

Figure 10:
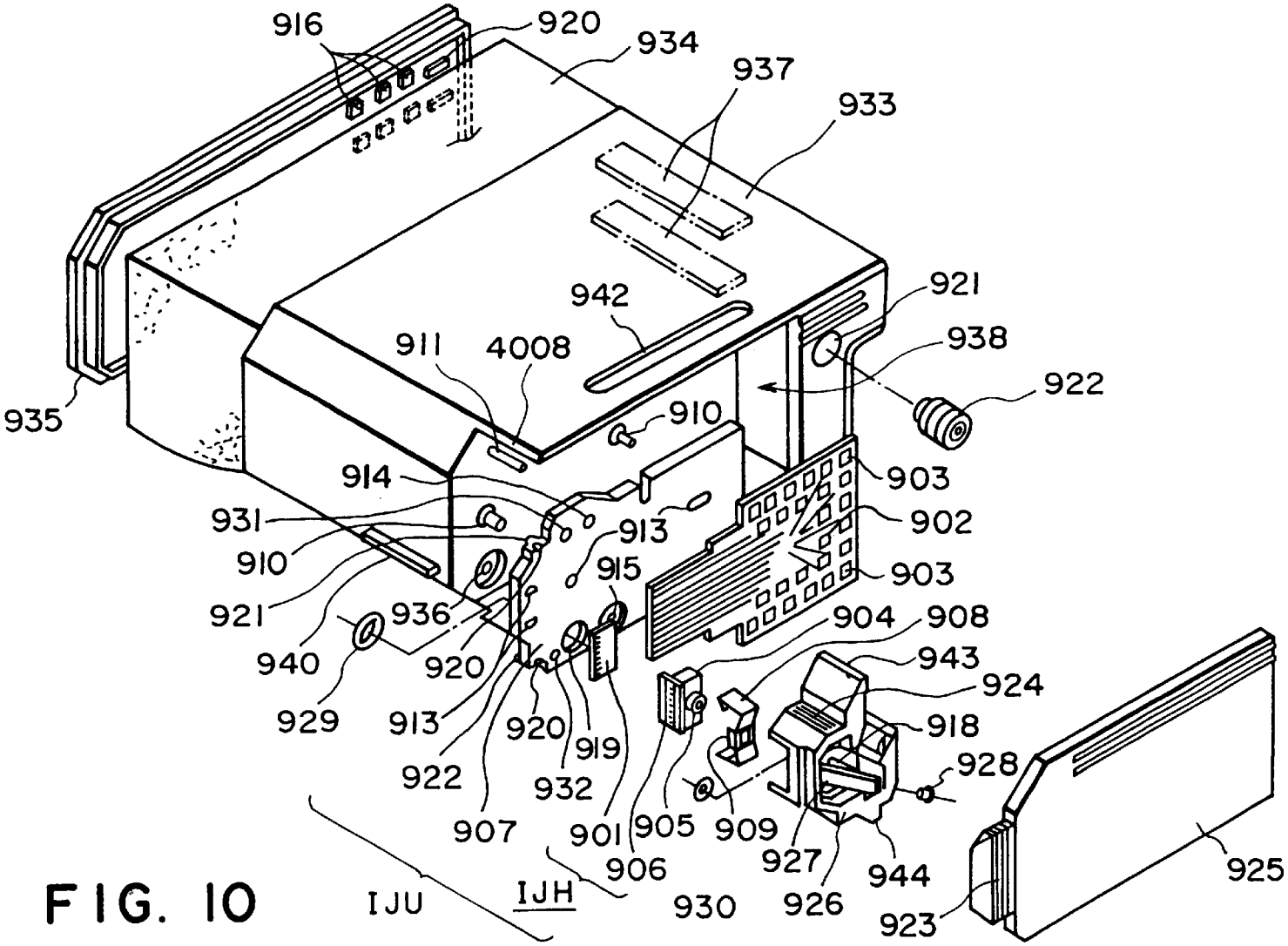
FIGS. 10–14 illustrate an ink jet recording apparatus using the ink jet recording head according to the present invention.

The recording head described above can be constituted into a cartridge shown in FIG. 10. In addition, the cartridge may be a reusable cartridge mountable to the ink jet printer shown in FIG. 14 to constitute an ink jet printer.

Figure 2:
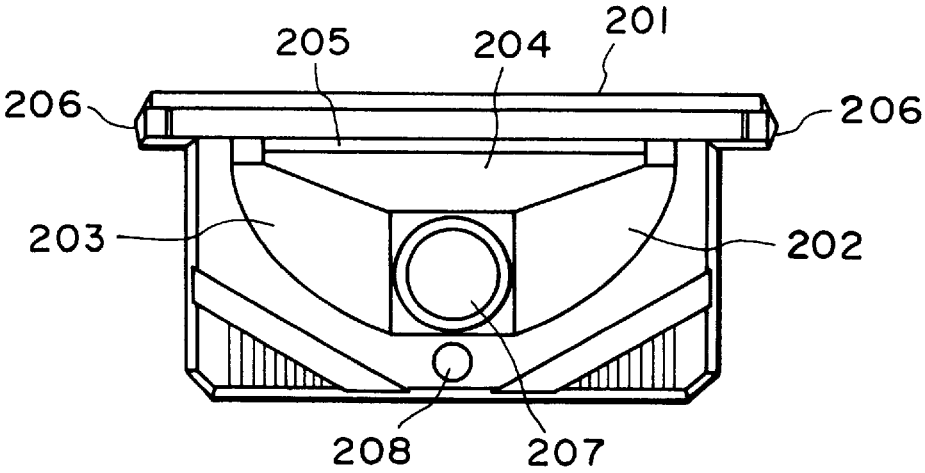
FIG. 2 is a top plan view of a common liquid chamber as seen from the ejection direction, according to another embodiment of the present invention.

FIG. 2 shows a recording head according to another embodiment. It is a top plan view as seen from the ejection direction. The internal wall of the common chamber from the ink supply port to the liquid passage is also slanted as in FIG. 1. In this embodiment, the lateral parts thereof are also inclined. The angle of slanting is 15 degrees at the portion B. The top plate is used in the ink jet recording head of the usable type. Examples are shown in FIGS. 2, 3 and 4.

Figure 3:
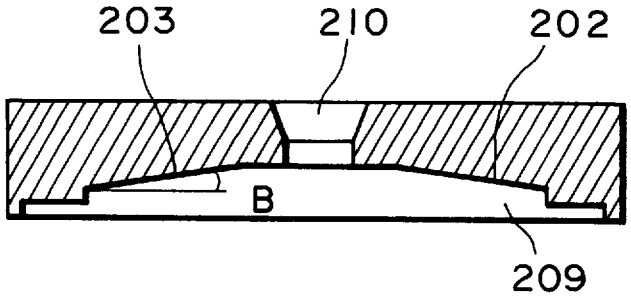
FIG. 3 is a sectional view of the common chamber of FIG. 2.
Figure 4:
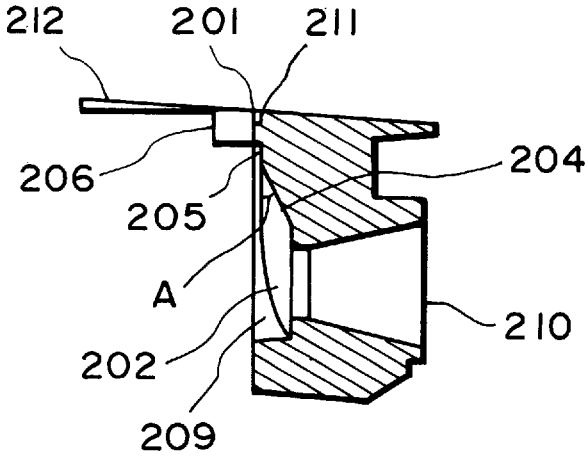
FIG. 4 is a sectional view of the device of FIG. 2.

In FIGS. 2–4, reference numeral 207 designates an ink inlet opening of the common chamber for supply of the ink to the common chamber; 201 designates an ejection outlet; 211 designates a linear liquid passage having a heat acting zone in which the energy generating element generates an energy acting on the liquid therein; 210 is an ink receptor opening; 212 designates an orifice plate integral with the common chamber; 206 designates a reinforcing member. In this embodiment, the thickness of the orifice plate 212 is not more than 1 mm, for example, in order to permit efficient laser machining. Because of the smaller thickness, the reinforcing member 206 is provided to prevent the orifice plate 212 from breaking the top plate. The member 206 is in the form of a square rib (approximately 0.39 mm) in the case of FIGS. 2–4 embodiment. Two of the reinforcing member 206 are provided at the left and right ends. Reference numeral 204 designates an internal wall of the common chamber extending from the ink receptor 207 toward the liquid passage 201; 202 and 203 designates lateral internal walls. In this embodiment, the slanted walls or surfaces are preferably flat surfaces. However, the slanted surfaces, particularly the lateral slanted surfaces 202 and 203 may be slightly curved within the limitation of the above-described angle.

Figure 8:
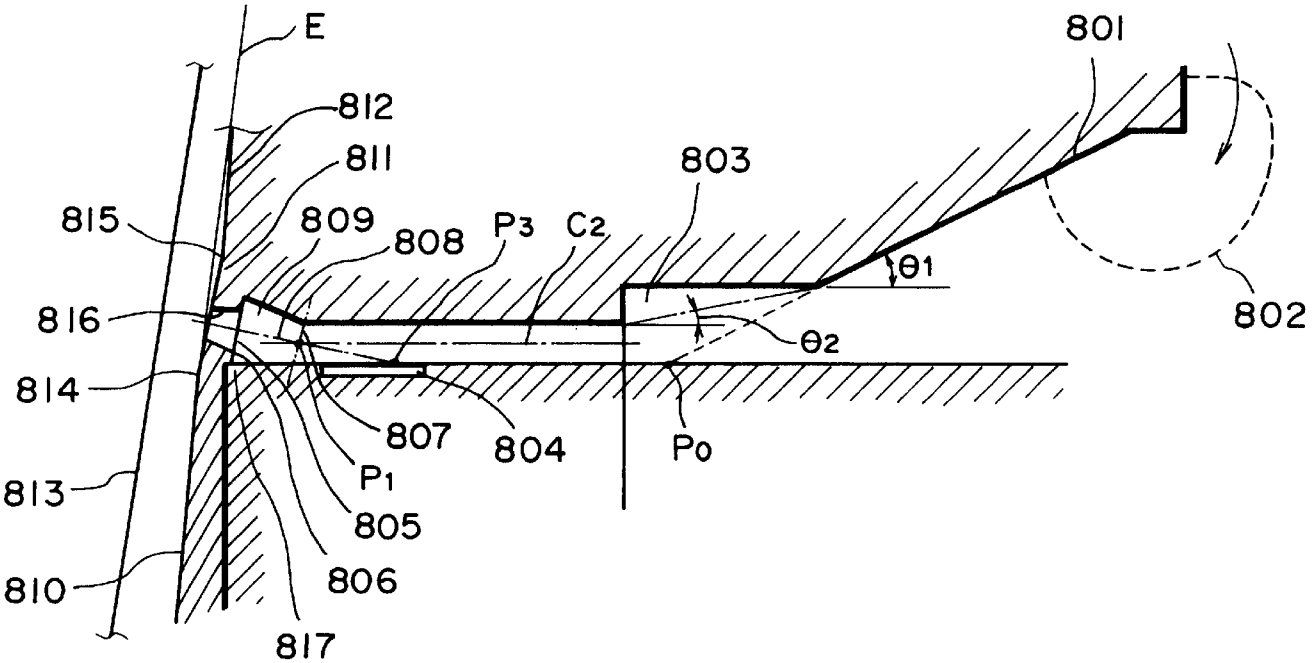
FIG. 8 is an enlarged view of an ink jet recording head shown in FIGS. 2, 3 and 4.

As will be understood from FIG. 8, the common chamber 209 includes a first region 205 (803) continuing from the liquid passage 201 and expanding toward the ink receptor 207 and a slanted surface 801 (204) continuing from the ink receptor 207 toward said region 803 (205). An extension of the slanted surface 801 (204) crosses at a point Po on a surface of the base plate which is the surface on which the energy generating element 804 is disposed. In this embodiment, the slanted surface 801 (204) forms an angle of 22 degrees (θ1) relative to the center line C2 of the ink passage. As will be understood from Figure, the angle B of the lateral internal slanted surfaces is 15 degrees.

By the provision of the expanding region 803 (205), the unnecessary fine bubbles can be concentrated. In addition, since the concentrated unnecessary bubbles are retained in the region away from the extension of the liquid passage having the energy generating element 804. By this alone, even if the bubbles are developed into a large bubble, the bubble is promoted along the slanted surface away from the liquid passage, and the occurrence of improper recording can be significantly delayed. The extension of the slanted surface reaches the extension of the surface on which the energy generating element is disposed. Therefore, even if the large bubble tends to move to the liquid passage by some impact or other, the large bubble abuts the extension of the surface on which the energy generating element is disposed (bottom surface). Therefore, the large unnecessary bubble does not enter the liquid passage. Therefore, the improper recording attributable to the bubble can be avoided. The angle limitations do not apply to this embodiment because of the above mechanism of solving the problems. However, the limitations are preferable because of the synergism effects.

Figure 9:
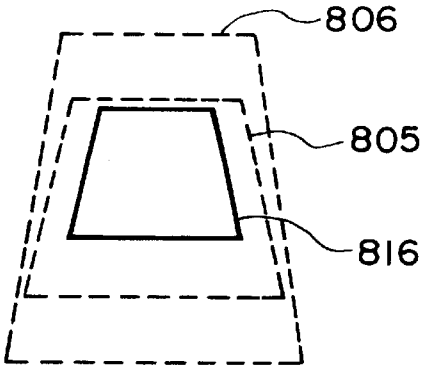
FIG. 9 illustrates the liquid passage, as seen from the ejection outlet, of the recording head of FIG. 8.

Referring to FIG. 9, a further embodiment will be described which is particularly effective upon sucking recovery operation, but is also applicable to a pressurizing recovery. FIG. 9 illustrates the liquid passage as seen from the ejection side of the recording head shown in FIG. 8. Reference numeral 806 designates an opening of the liquid passage at the orifice plate side, the opening 806 has a symmetric trapezoidal configuration. Reference numeral 805 designates an internal opening of the orifice plate 810, continuing from the opening 806. The internal opening 805 also has the symmetric trapezoidal configuration. Reference numeral 816 designates an ejection outlet for ejecting the liquid to the outside. The ejection outlet 816 also has the symmetric trapezoidal configuration. Thus, in this embodiment, the ink flow passage has the symmetric trapezoidal cross-section, including the ejection outlet 816. In addition, the ejection energy generating element 804 is disposed at the bottom side (larger side) of the trapezoidal configuration. By doing so, the dispersion of the unnecessary bubbles to the entire internal walls of the liquid passage is made uniform so that the unnecessary bubbles produced or introduced are concentrated to the shorter side of the trapezoid, and in addition, the movement direction of the bubbles can be concentrated upon the recovery operation. Therefore, the bubble removing effects can be enhanced further. Because the short side of the trapezoid of the liquid passage correspond to the short side of the trapezoid of the ejection outlet, and the long side corresponds to the long side. Therefore, the turbulent flow of the ink can be prevented upon the recovery operation, so that the unnecessary bubble discharging effect can be further stabilized. The symmetricity of the trapezoidal configuration is further preferable.

In this embodiment, further preferably, there are a first region in which the liquid passage expands while maintaining the symmetric trapezoidal configuration (liquid passage region from line P1 to the openings 806 and 805) and a second region in which the liquid passage is converging while maintaining the symmetric trapezoidal configuration (from the opening 816 to the opening 805). Therefore, the turbulent flow of the ink is hardly produced, so that the unnecessary bubbles can be removed with certainty.

Referring back to FIG. 8, said first and second regions are disposed in symmetric manner about a plane 808 provided by connecting the centers of the sides of the trapezoid, and therefore, the pressure distribution upon the recovery operation can be made uniform, so that the production of eddy or turbulent flow can be significantly reduced in the discharging region. An extension of the line 808 crosses the heat generating element 804 at a point P3 thereon, and therefore, the energy produced by the energy generating element 804 is efficiently used for the ejection of the liquid.

The top plate can be joined with the base plate by a clamp applying a line pressure for the purpose of simple structure. The present invention is applicable to such a case without the inconveniences attributable to the production of the unnecessary bubbles. In this embodiment, the front surface of the orifice plate is constituted by three surfaces 810, 811 and 812 connected at 814 and 815. Then, the direction of the liquid ejection is stabilized to be an extension of the line 808, and therefore, the recording surface is perpendicular to the line 808. In this embodiment, the recording surface moves upwardly. The orifice plate has a stepped cross-section with small inclination portion in which the ejection outlets 816 are formed. Therefore, the wiping of the ejection side surface of the orifice plate can be assuredly performed without particular part or parts in the cap or outside the cap. In addition, the retraction of the meniscus can be prevented at the time of the capping operation to the ejection outlets 816. Therefore, various problems resulting from the improper ejection of the ink can be solved with the simple structure.

Referring to FIG. 8, the height of the zone 803 is preferably the same as or smaller than the height of the liquid passage, and an angle θ2 formed by the region 803 is 10 degrees and is preferably not more than one half the angle θ of the slanted surface 801.

As described in the foregoing, according to the present invention, the internal wall of the liquid chamber from the ink supply port thereto is slanted at least one direction, preferably, in three directions. Therefore, the unnecessary bubbles entering the chamber can be discharged through the ejection outlets before they are developed.

The effects of the invention were confirmed by experiments wherein the unnecessary bubbles in the common chamber were removed through the ejection outlets by pumping. The results are shown in Table 3.

TABLE 3

| | |
|---|---|
| 1 slanted surface | 0.12 cc |
| 3 slanted surface | 0.05 cc |
| No slant | Bubbles remained |

The data are quantities of ink discharged until the unnecessary bubbles are sucked out, and therefore, the smaller quantity means quicker removal of the bubbles.

The results show that the slanted surfaces of the internal walls of the common chamber is preferable to the rectangular liquid chamber (FIG. 11) in order to remove the unnecessary bubbles.

FIGS. 10, 11, 12, 13 and 14 illustrate an ink jet unit IJU, an ink jet heat IJH, an ink container IT, an ink jet cartridge IJC, a head carriage HC and a main assembly IJRA of an ink jet recording apparatus, according to an embodiment of the present invention, and relations among them. The structures of the respective elements will be described in the following.

Figure 11:
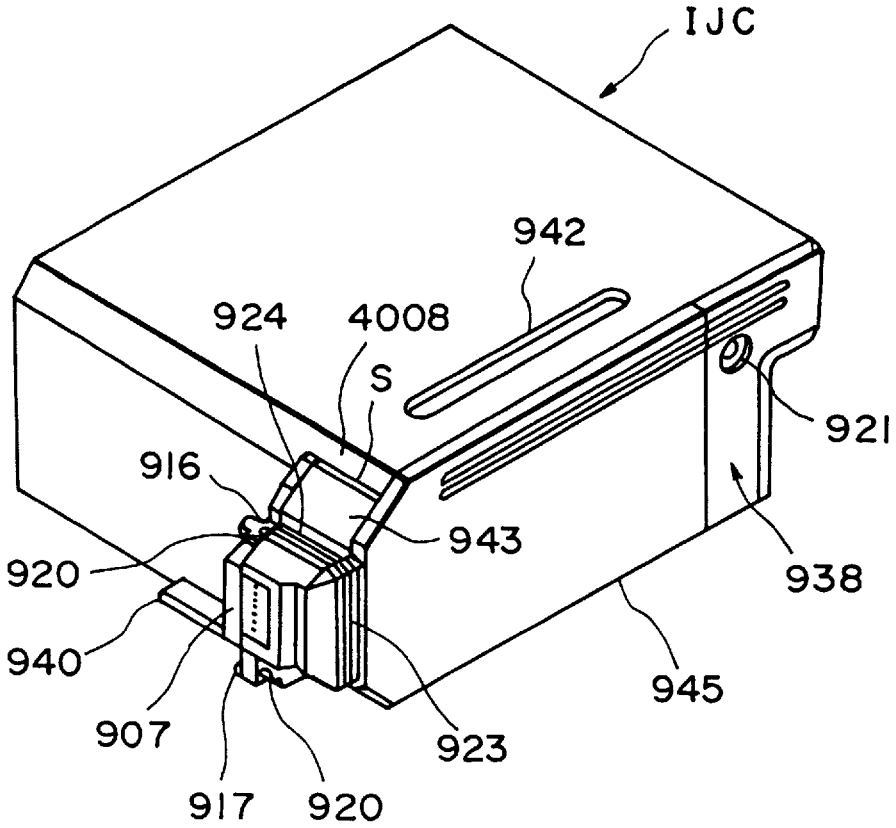

As will be understood from the perspective view of FIG. 11, the ink jet cartridge IJC in this embodiment has a relatively large ink accommodation space, and an end portion of the ink jet unit IJU is slightly projected from the front side surface of the ink container IT. The ink jet cartridge IJC is mountable at correct position on the carriage HC (FIG. 13) of the ink jet recording apparatus main assembly IJRA by proper positioning means and with electric contacts, which will be described in detail hereinafter. It is, in this embodiment, a disposable type head detachably mountable on the carriage AC. The structures disclosed in FIGS. 10–14 contain various novel features, which will first be described generally.

(i) Ink Jet Unit IJU

The ink jet unit IJU is of a bubble jet recording type using electrothermal transducers which generate thermal energy, in response to electric signals, to produce film boiling of the ink.

Referring to FIG. 10, the unit comprises a heater board 901 having electrothermal transducers (ejection heaters) arranged in a line on an Si substrate and electric lead lines made of aluminum or the like to supply electric power thereto. The electrothermal transducer and the electric leads are formed by a film forming process. A wiring board 902 is associated with the heater board 901 and includes wiring corresponding to the wiring of the heater board 901 (connected by the wire bonding technique, for example) and pads 903 disposed at an end of the wiring to receive electric signals from the main assembly of the recording apparatus.

A top plate 904 is provided with grooves which define partition walls for separating adjacent ink passages and a common liquid chamber for accommodating the ink to be supplied to the respective ink passages. The top plate 904 is formed integrally with an ink jet opening 905 for receiving the ink supplied from the ink container IT and directing the ink to the common chamber, and also with an orifice plate 906 having the plurality of ejection outlets corresponding to the ink passages. The material of the integral mold is preferably polysulfone, but may be another molding resin material.

A supporting member 907 is made of metal, for example, and functions to support a backside of the wiring board 902 in a plane, and constitutes a bottom plate of the ink jet unit IJU. A confining spring 908 is in the form of "M" having a central portion urging to the common chamber with a light pressure, and a clamp 909 urges concentratedly with a line pressure to a part of the liquid passage, preferably the part in the neighborhood of the ejection outlets. The confining spring 908 has legs for clamping the heater board 901 and the top plate 904 by penetrating through the openings 913 of the supporting plate 907 and engaging the back surface of the supporting plate 907. Thus, the heater board 901 and the top plate 907 are clamped by the concentrated urging force by the legs and the clamp 909 of the spring 908. The supporting plate 907 has positioning openings 913, 914 and 915 engageable with two positioning projections 910 and positioning and fuse-fixing projections 911 and 912 of the ink container IT. It further includes projections 916 and 917 at its backside for the positioning relative to the carriage HC of the main assembly IJRA.

In addition, the supporting member 907 has a hole 320 through which an ink supply pipe 918, which will be described hereinafter, is penetrated for supplying ink from the ink container. The wiring board 902 is mounted on the supporting member 907 by bonding agent or the like. The supporting member 907 is provided with recesses 920 and 920 adjacent the positioning projections 917 and 917.

Figure 13:
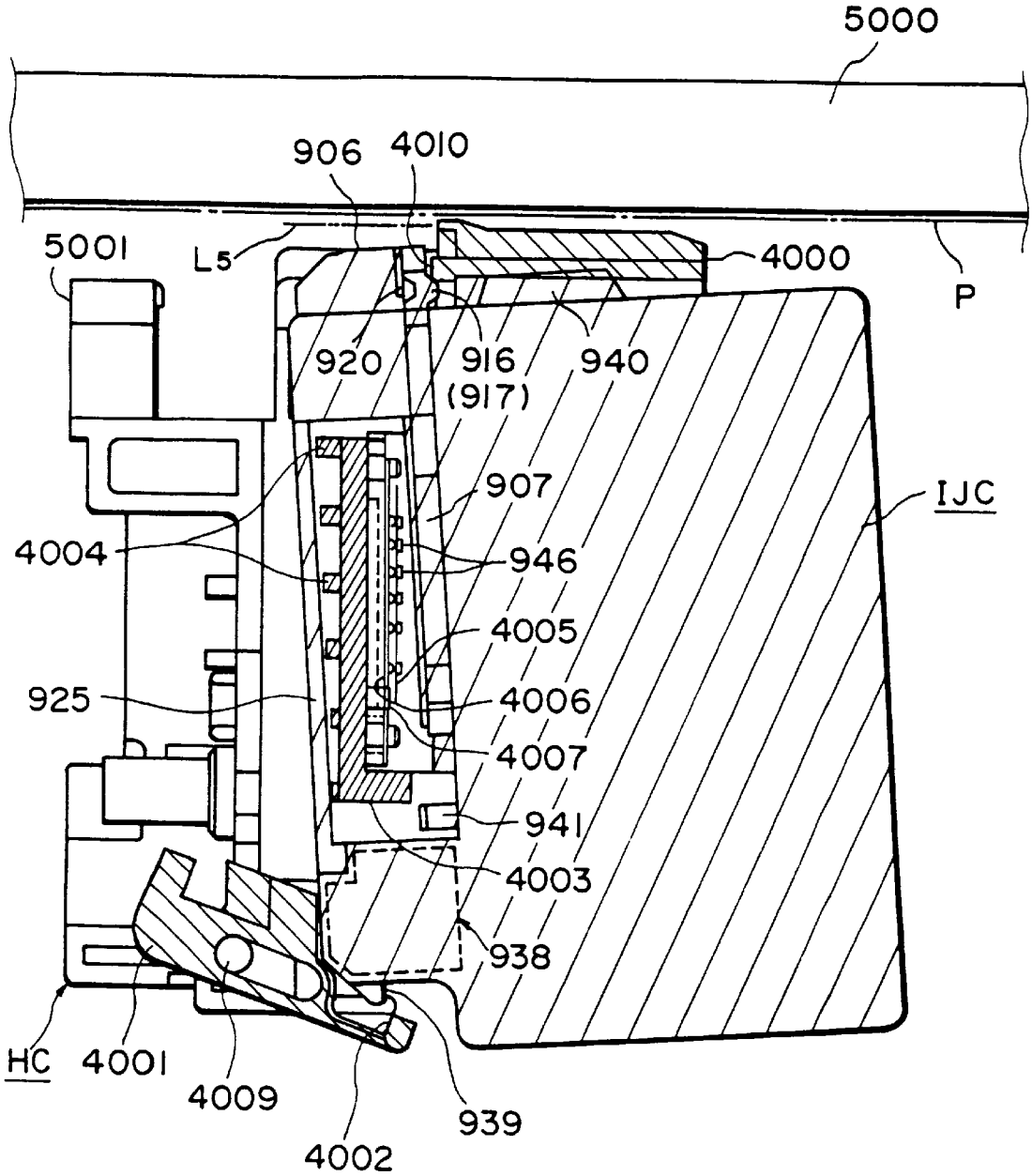

As shown in FIG. 11, the assembled ink jet cartridge IJC has a head projected portion having three sides provided with plural parallel grooves 923 and 924. The recesses 920 and 920 are located at extensions of the parallel grooves at the top and bottom sides to prevent the ink or foreign matter moving along the groove from reaching the projections 916 and 917. The covering member 925 having the parallel grooves 923, as shown in FIG. 13, constitutes an outer casing of the ink jet cartridge IJC and cooperates with the ink container to define a space for accommodating the ink jet unit IJU. The ink supply member 926 having the parallel groove 924 has an ink conduit pipe 927 communicating with the above-described ink supply pipe 918 and cantilevered at the supply pipe 918 side. In order to assure the capillary action at the fixed side of the ink conduit pipe 927 and the ink supply pipe 918, a sealing pin 928 is inserted.

A gasket 929 seals the connecting portion between the ink container IT and the supply pipe 918. A filter 930 is disposed at the container side end of the supply pipe. The ink supply member 926 is molded, and therefore, it is produced at low cost with high positional accuracy. In addition, the cantilevered structure of the conduit 927 assures the press-contact between the conduit 927 and the ink inlet 905 even if the ink supply member 926 is mass-produced.

In this embodiment, the complete communicating state can be assuredly obtained simply by flowing sealing bonding agent from the ink supply member side under the press-contact state. The ink supply member 926 may be fixed to the supporting member 907 by inserting and penetrating backside pins (not shown) of the ink supply member 926 through the openings 931 and 932 of the supporting member 907 and by heat-fusing the portion where the pins are projected through the backside of the supporting member 907. The slight projected portions thus heat-fused are accommodated in recesses (not shown) in the ink jet unit (IJU) mounting side surface of the ink container IT, and therefore, the unit IJU can be correctly positioned.

(ii) Ink Container IT

The ink container comprises a main body 933, an ink absorbing material and a cover member 935. The ink absorbing material 934 is inserted into the main body 933 from the side opposite from the unit (IJU) mounting side, and thereafter, the cover member 935 seals the main body.

The ink absorbing material 934 is thus disposed in the main body 933. The ink supply port 936 functions to supply the ink to the ink jet unit IJU comprising the above-described parts 901–906, and also functions as an ink injection inlet to permit initial ink supply to the absorbing material 901 before the unit IJU is mounted to the portion 935 of the main body.

In this embodiment, the ink may be supplied through an air vent port and this supply opening. In order to good supply of ink, ribs 937 is formed on the inside surface of the main body 933, and ribs 916 and 920 are formed on the inside of the cover member 935, which are effective to provide within the ink container an ink existing region extending continuously from the air vent port side to that corner portion of the main body which is most remote from the ink supply opening 936. Therefore, in order to uniformly distribute the ink in good order, it is preferable that the ink is supplied through the supply opening 936. This ink supply method is practically effective. The number of the ribs 937 in this embodiment is four, and the ribs 937 extend parallel to a movement direction of the carriage adjacent the rear side of the main body of the ink container, by which the absorbing material 934 is prevented from closely contacted to the inner surface of the rear side of the main body. The ribs 916 and 920 are formed on the inside surface of the cover member 935 at a position which is substantially an extension of the ribs 937; however, as contrasted to the large rib 937, the size of the ribs 916 and 920 are small as if it is divided ribs, so that the air existing space is larger with the ribs 916 and 920 than with the rib 937. The ribs 916 and 920 are distributed on the entire area of the cover member 935, and the area thereof is not more than one half of the total area. Because of the provisions of the ribs, the ink in the corner region of the ink absorbing material which is most remote from the supply opening 926 can be stably and assuredly supplied to the inlet opening by capillary action. The cartridge is provided with an air vent port for communication between the inside of the cartridge with the outside air. Inside the vent port 922, there is a water repellent material 922 to prevent the inside ink from leaking outside through the vent port 922.

The ink accommodating space in the ink container IT is substantially rectangular parallelepiped, and the long side faces in the direction of carriage movement, and therefore, the above-described rib arrangements are particularly effective. When the long side extends along the movement direction of the carriage, or when the ink containing space is in the form of a cube, the ribs are preferably formed on the entire surface of the inside of the cover member 935 to stabilize the ink supply from the ink absorbing material 933. The cube configuration is preferable from the standpoint of accommodating as much as possible ink in limited space. However, from the standpoint of using the ink with minimum an available part in the ink container, the provisions of the ribs formed on the two surfaces constituting a corner.

In this embodiment, the inside ribs 916 and 920 of the ink container IT are substantially uniformly distributed in the direction of the thickness of the ink absorbing material having the rectangular parallelepiped configuration. Such a structure is significant, since the air pressure distribution in the ink container IT is made uniform when the ink in the absorbing material is consumed so that the quantity of the remaining unavailable ink is substantially zero. It is preferable that the ribs are disposed on the surface or surfaces outside a circular arc having the center at the projected position on the ink supply opening 936 on the top surface of the rectangular ink absorbing material and having a radius which is equal to the long side of the rectangular shape, since then the ambient air pressure is quickly established for the ink absorbing material present outside the circular arc. The position of the air vent of the ink container IT is not limited to the position of this embodiment if it is good for introducing the ambient air into the position where the ribs are disposed.

In this embodiment, the backside of the ink jet cartridge IJC is flat, and therefore, the space required when mounted in the apparatus is minimized, while maintaining the maximum ink accommodating capacity. Therefore, the size of the apparatus can be reduced, and simultaneously, the frequency of the cartridge exchange is minimized. Utilizing the rear space of the space used for unifying the ink jet unit IJU, a projection for the air vent port 921. The inside of the projection is substantially vacant, and the vacant space 938 functions to supply the air into the ink container IT uniformly in the direction of the thickness of the absorbing material. Because of these features described above, the cartridge as a whole is of better performance than the conventional cartridge. The air supply space 938 is much larger than that in the conventional cartridge. In addition, the air vent port 921 is at an upper position, and therefore, if the ink departs from the absorbing material for some reason or another, the air supply space 938 can tentatively retain the ink to permit such ink to be absorbed back into the absorbing material. Therefore, the wasteful consumption of the ink can be saved.

Figure 12:
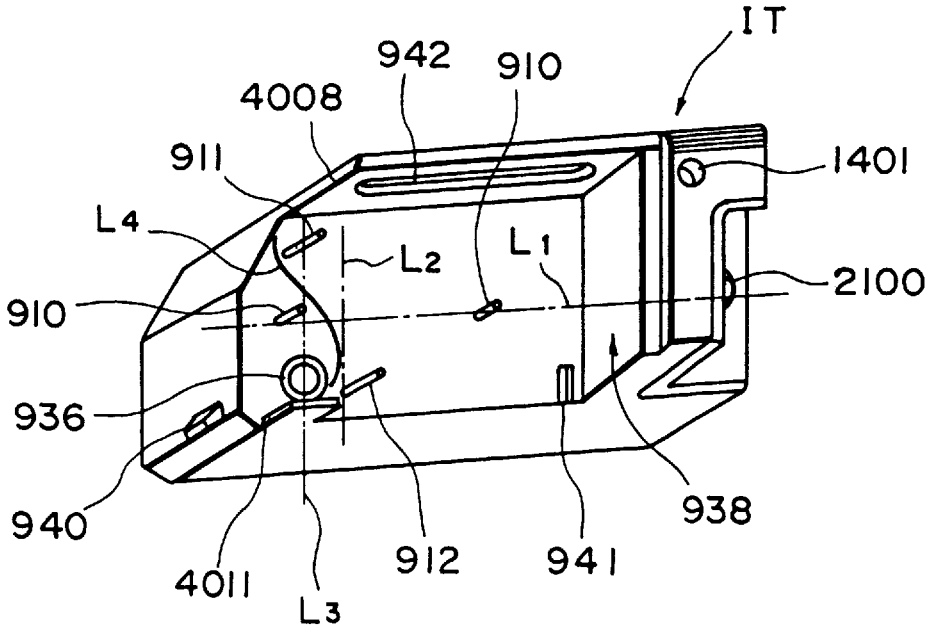

Referring to FIG. 12, there is shown a structure of a surface of the ink container IT to which the unit IJU is mounted. Two positioning projections 910 are on a line L1 which is a line passing through the substantial center of the array of the ejection outlets in the orifice plate 906 and parallel with the bottom surface of the ink container IT or the parallel to the ink container supporting reference surface of the carriage. The height of the projections 910 is slightly smaller than the thickness of the supporting member 907, and the projections 910 function to correctly position the supporting member 907. On an extension (right side) in this Figure, there is a pawl 939 with which a right angle engaging surface 4002 of a carriage positioning hook 4001 is engageable. Therefore, the force for the positioning of the ink jet unit relative to the carriage acts in a plane parallel to a reference plane including the line L1. These relationships are significant, since the accuracy of the ink container positioning becomes equivalent to the positioning accuracy of the ejection outlet of the recording head, which will be described hereinafter in conjunction with FIG. 13.

Projections 911 and 912 corresponding to the fixing holes 914 and 915 for fixing the supporting member 907 to the side of the ink container IT, are longer than the projections 910, so that they penetrate through the supporting member 907, and the projected portions are fused to fix the supporting member 907 to the side surface. When a line L3 passing through the projection 911 and perpendicular to the line L1, and a line L2 passing through the projection 912 and perpendicular to the line L1, are drawn. The center of the supply opening 936 is substantially on the line L3, the connection between the supply opening 936 and a supply type 918 is stabilized, and therefore, even if the cartridge falls, or even if a shock is imparted to the cartridge, the force applied to the connecting portion can be minimized. In addition, since the lines L2 and L3 are not overlapped, and since the projections 911 and 912 are disposed adjacent to that projection 910 which is nearer to the ink ejection outlets of the ink jet head, the positioning of the ink jet unit relative to the ink container is further improved. In this Figure, a curve L4 indicates the position of the outer wall of the ink supply member 926 when it is mounted. Since the projections 911 and 912 are along the curve L4, the projections are effective to provide sufficient mechanical strength and positional accuracy against the weight of the end structure of the head IJH.

An end projection 940 of the ink container IT is engageable with a whole formed in the front plate 4000 of the carriage to prevent the ink cartridge from being displaced extremely out of the position. A stopper 941 is engageable with an unshown rod of the carriage HC, and when the cartridge IJC is correctly mounted with rotation, which will be described hereinafter, the stopper 941 take a position below the rod, so that even if an upward force tending to disengage the cartridge from the correct position is unnecessarily applied, the correct mounted state is maintained. The ink container IT is covered with a cover 925 after the unit IJU is mounted thereto. Then, the unit IJU is enclosed therearound except for the bottom thereof. However, the bottom opening thereof permits the cartridge IJC to be mounted on the carriage HC, and is close to the carriage HC, and therefore, the ink jet unit is substantially enclosed at the six sides. Therefore, the heat generation from the ink jet head IJH which is in the enclosed space is effective to maintain the temperature of the enclosed space.

However, if the cartridge IJC is continuously operated for a long period of time, the temperature slightly increases. Against the temperature increase, the top surface of the cartridge IJC is provided with a slit 942 having a width smaller than the enclosed space, by which the spontaneous heat radiation is enhanced to prevent the temperature rise, while the uniform temperature distribution of the entire unit IJU is not influenced by the ambient conditions.

After the ink jet cartridge IJC is assembled, the ink is supplied from the inside of the cartridge to the chamber in the ink supply member 926 through a supply opening 936, the whole 919 of the supporting member 907 and an inlet formed in the backside of the ink supply member 926. From the chamber of the ink supply member 926, the ink is supplied to the common chamber through the outlet, supply pipe and an ink inlet 905 formed in the top plate 904. The connecting portion for the ink communication is sealed by silicone rubber or butyl rubber or the like to assure the hermetical seal.

In this embodiment, the top plate 904 is made of resin material having resistivity to the ink, such as polysulfone, polyether sulfone, polyphenylene oxide, polypropylene. It is integrally molded in a mold together with an orifice plate portion 906.

As described in the foregoing, the integral part comprises the ink supply member 926, the top plate 904, the orifice plate 906 and parts integral therewith, and the ink container body 933. Therefore, the accuracy in the assembling is improved, and is convenient in the mass-production. The number of parts is smaller than inconventional device, so that the good performance can be assured.

In this embodiment, as shown in FIGS. 10–12, the configuration after assembly is such that the top portion 943 of the ink supply member 926 cooperates with an end of the top thereof having the slits 942, so as to form a slit S, as shown in FIG. 11. The bottom portion 944 cooperates with fed side end 4011 of a thin plate to which the bottom cover 925 of the ink container IT is bonded, so as to form a slit (not shown) similar to the slit S. The slits between the ink container IT and the ink supply member 926 are effective to enhance the heat radiation, and is also effective to prevent an expected pressure to the ink container IT from influencing directly the supply member or to the ink jet unit IJT.

The above-described various structures are individually effective to provide the respective advantages, and also they are most effective when they are combined each other.

(iii) Mounting of the Ink Jet Cartridge IJC to the Carriage HC

In FIG. 13, a platen roller 5000 guides the recording medium P from the bottom to the top. The carriage HC is movable along the platen roller 5000. The carriage HC comprises a front plate 4000, a supporting plate 4003 for electric connection and a positioning hook 4001. The front plate 906 has a thickness of 2 mm, and is disposed closer to the platen. The front plate 4000 is disposed close to the front side of the ink jet cartridge IJC, when the cartridge IJC is mounted to the carriage. The supporting plate 4003 supports a flexible sheet 4005 having pads 946 corresponding to the pads 903 of the wiring board 902 of the ink jet cartridge IJC and a rubber pad sheet 4007 for producing elastic force for urging the backside of the flexible sheet 4005 to the pads 903. The positioning hook 4001 functions to fix the ink jet cartridge IJC to the recording position. The front plate 4000 is provided with two positioning projection surfaces 4010 corresponding to the positioning projections 916 and 917 of the supporting member 907 of the cartridge described hereinbefore. After the cartridge is mounted, the front plate receives the force in the direction perpendicular to the projection surfaces 4010. Therefore, plural reinforcing ribs (not shown) are extended in the direction of the force at the platen roller side of the front plate. The ribs project toward the platen roller slightly (approximately 0.1 mm) from the front side surface position L5 when the cartridge IJC is mounted, and therefore, they function as head protecting projections. The supporting plate 4003 is provided with plural reinforcing ribs 4004 extending in a direction perpendicular to the above-described front plate ribs. The reinforcing ribs 4004 have heights which decreases from the plate roller side to the hook 4001 side. By this, the cartridge is inclined as shown in FIG. 13, when it is mounted.

The supporting plate 4003 is provided with two additional positioning surfaces 4006 at the lower left portion, that is, at the position closer to the hook. The positioning surfaces 4006 correspond to projection surfaces 4010 by the additional positioning surfaces 4006, the cartridge receives the force in the direction opposite from the force received by the cartridge by the above-described positioning projection surfaces 4010, so that the electric contacts are stabilized. Between the upper and lower projection surfaces 4010, there is disposed a pad contact zone, so that the amount of deformation of the projections of the rubber sheet 4007 corresponding to the pad 946 is determined. When the cartridge IJC is fixed at the recording position, the positioning surfaces are brought into contact with the surface of the supporting member 907. In this embodiment, the pads 903 of the supporting member 907 are distributed so that they are symmetrical with respect to the above-described line L1, and therefore, the amount of deformation of the respective projections of the rubber sheet 4007 are made uniform to stabilize the contact pressure of the pads 946 and 903. In this embodiment, the pads 903 are arranged in two columns and upper and bottom two rows.

The hook 4001 is provided with an elongated whole engageable with a fixed pin 4009. Using the movable range provided by the elongated hole, the hook 4001 rotates in the counterclockwise direction, and thereafter, it moves leftwardly along the platen roller 5000, by which the ink jet cartridge IJC is positioned to the carriage HC. Such a movable mechanism of the hook 4001 may be accomplished by another structure, but it is preferable to use a lever or the like. During the rotation of the hook 4001, the cartridge IJC moves from the position shown in FIG. 13 to the position toward the platen side, and the positioning projections 916 and 917 come to the position where they are engageable to the positioning surfaces 4010. Then, the hook 4001 is moved leftwardly, so that the hook surface 4002 is contacted to the pawl 939 of the cartridge IJC, and the ink cartridge IJC rotates about the contact between the positioning surface 916 and the positioning projection 4010 in a horizontal plane, so that the pads 903 and 946 are contacted to each other. When the hook 4001 is locked, that is retained at the fixing or locking position, by which the complete contacts are simultaneously established between the pads 903 and 946, between the positioning portions 916 and 4010, between the standing surface 4002 and the standing surface of the pawl and between the supporting member 907 and the positioning surface 4006, and therefore, the cartridge IJC is completely mounted on the carriage.

(iv) General Arrangement of the Apparatus

Figure 14:
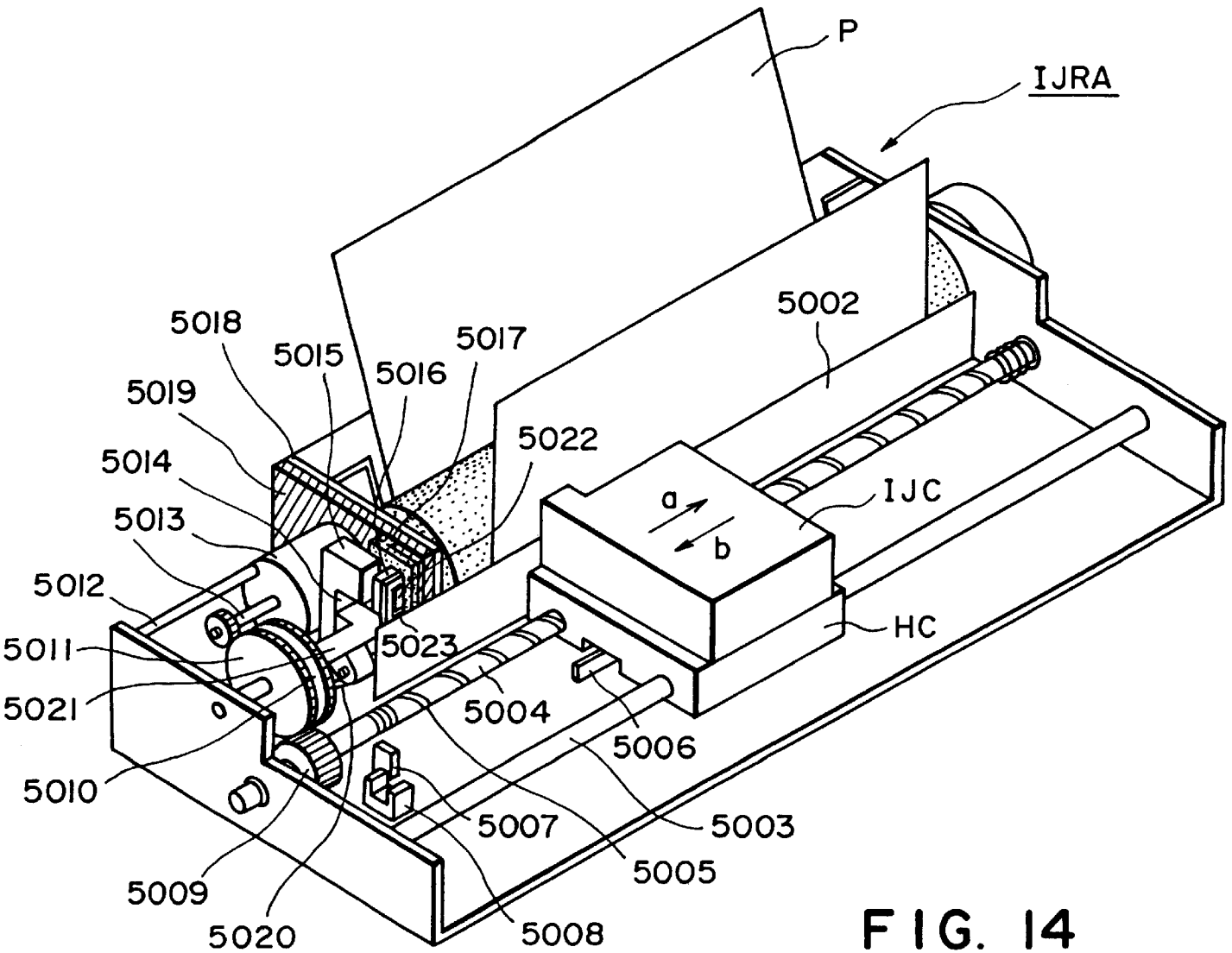

FIG. 14 is a perspective view of an ink jet recording apparatus IJRA in which the present invention is used. A lead screw 5005 rotates by way of a drive transmission gears 5011 and 5009 by the forward and backward rotation of a driving motor 5013. The lead screw 5005 has a helical groove 5004 with which a pin (not shown) of the carriage HC is engaged, by which the carriage HC is reciprocable in directions a and b. A sheet confining plate 5002 confines the sheet on the platen over the carriage movement range. Home position detecting means 5007 and 5008 are in the form of a photocoupler to detect presence of a lever 5006 of the carriage, in response to which the rotational direction of the motor 5013 is switched. A supporting member 5016 supports the front side surface of the recording head to a capping member 5022 for capping the recording head. Sucking means 5015 functions to suck the recording head through the opening 5023 of the cap so as to recover the recording head.

A cleaning blade 5017 is moved toward front and rear by a moving member 5019. They are supported on the supporting frame 5018 of the main assembly of the apparatus. The blade may be in another form, more particularly, a known cleaning blade. A lever 5021 is effective to start the sucking recovery operation and is moved with the movement of a cam 5020 engaging the carriage, and the driving force from the driving motor is controlled by known transmitting means such as clutch or the like.

The capping, cleaning and sucking operations can be performed when the carriage is at the home position by the lead screw 5005, in this embodiment. However, the present invention is usable in another type of system wherein such operations are effected at different timing. The individual structures are advantageous, and in addition, the combination thereof is further preferable.

The present invention is particularly suitably usable in a bubble jet recording head and recording apparatus developed by Canon Kabushiki Kaisha, Japan. This is because, the high density of the picture element, and the high resolution of the recording are possible.

The typical structure and the operational principle of preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such quick temperature rise beyond a the maxium nucleate boiling temperature, by which the thermal energy is provide by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single corresponding to a single color ink, or may be plural corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording head for recording on a recording medium using an ink, comprising:

a plurality of liquid passages terminating in respective ejection outlets, at respective longitudinal ends of said liquid passages, for ejection of the ink and each having an ejection energy generating means for generating ejection energy provided on a substrate, said liquid passages being approximately parallel to one another and being disposed in a plane;

a liquid chamber in fluid communication with said plurality of liquid passages, said liquid chamber containing the ink to be supplied to said liquid passages;

an inlet for supplying the ink to said liquid chamber, wherein said ejection outlets, said liquid passage and said liquid chamber are arranged in this order from one end of said ink jet recording head, and said liquid chamber having a first slanted inner surface extending from said inlet to said liquid passages, a second slanted inner surface and a third slanted inner surface extending from said inlet laterally with respect to a direction in which said passages extend and continuously from said first slanted surface, said first, said second and said third slanted surfaces being inclined relative to a plane of said substrate, and having a region, disposed between said liquid passages and said first slanted portion, for suppressing movement of the bubble toward said liquid passages.

2. An ink jet recording head according to claim 1, wherein said ejection energy generating means comprises an electrothermal transducer in said liquid passage for producing film boiling of the ink.

3. An ink jet recording head according to claim 1, wherein said chamber has an internal surface which is slanted in a lateral direction at an angle of 5–40 degrees.

4. An ink jet recording head according to claim 3, wherein said first-mentioned angle is larger than said second-mentioned angle.

5. An ink jet recording head according to claim 3, wherein said liquid passage has a trapezoidal cross-section having a longer side aligned with a surface on which an ejection energy generating means is disposed.

6. A recording head according to claim 5, wherein said first-mentioned angle is larger than said second-mentioned angle.

7. A recording head according to claim 6, wherein said ejection outlet has a corresponding trapezoidal configuration.

8. An ink jet recording head according to claim 7, wherein the trapezoidal configuration is symmetric.

9. An ink jet recording head according to claim 6, further comprising a first region wherein said liquid passage is expanding adjacent said ejection outlet while maintaining the trapezoidal configuration and a second region wherein the liquid passage is converging while maintaining the trapezoidal configuration to said ejection outlet.

10. A recording head according to claim 9, wherein said first and second regions are symmetric about a plane connecting centers of the sides of the trapezoidal configuration.

11. A recording head according to claim 6 wherein there is a region between said liquid passage and said slanted surface which expands toward said ink inlet, and an extension of said slanted surface abuts a surface on which said ejection energy generating means is disposed.

12. An ink jet recording head according to claim 1, wherein said liquid chamber has a region continuing from said liquid passage and expanding to said ink inlet, said slanted internal surface extending from said ink inlet to said region, wherein an extension of said slanted surface abuts a surface on which an energy generating element is disposed.

13. A recording head according to claim 12, wherein said slanted internal surface forms an angle of 5–30 degrees relative to an extension of said liquid passage.

14. A recording head according to claim 12, wherein said chamber has an internal surface which is slanted in a lateral direction at an angle of 5–30 degrees.

15. A recording head according to claim 14, wherein the angle of said laterally slanted surface is smaller than said first-mentioned angle.

16. An ink jet recording head according to claim 12, wherein said ink jet recording head is detachably mountable in an ink jet recording apparatus.

17. A recording head according to claim 16, wherein said liquid chamber is molded.

18. A recording head according to claim 17, wherein said liquid chamber is provided with an ink supply member.

19. A recording head according to claim 12, wherein said liquid chamber has another internal surface which is slanted in a lateral direction at an angle of 5–40 degrees.

20. An ink jet recording head according to claim 1, wherein said recording head is carried on a carriage having a carrying surface inclined from a horizontal plane at an angle less than 45 degrees.

21. An ink jet recording head according to claim 1, wherein the ink is sucked out through the ejection outlets upon a recovery operation for said recording head.

22. An ink jet recording head according to claim 1, wherein a member in which said ejection outlets are provided and a member constituting said liquid passages are integrally formed, and the ejection outlets are formed by a laser beam.

23. An ink jet recording head according to claim 1, wherein a member in which said ejection outlets are provided and said substrate are abutted to each other, positioned to each other and connected to each other.

24. An ink jet recording apparatus, comprising;

an ink jet recording head for recording on a recording medium using an ink, said ink jet recording head including;

a plurality of liquid passages terminating in respective ejection outlets, at respective longitudinal ends of said liquid passages, for ejection of the ink and each having an ejection energy generating means for generating ejection energy provided on a substrate, said liquid passages being approximately parallel to one another and being disposed in a plane;

a liquid chamber in fluid communication with said plurality of liquid passages, said liquid chamber containing the ink to be supplied to said liquid passages;

an inlet for supplying the ink to said liquid chamber, wherein said ejection outlets, said liquid passage and said liquid chamber are arranged in this order from one end of said ink jet recording head, and said liquid chamber having a first slanted inner surface extending from said inlet to said liquid passages, a second slanted inner surface and a third slanted inner surface extending from said inlet laterally with respect to a direction in which said passages extend and continuously from said first slanted surface, and having a region, disposed between said liquid passages and said first slanted portion, for suppressing movement of the bubble toward the liquid passages; and sucking means for sucking the ink out of said recording head through said ejection outlet.

25. An ink jet recording apparatus according to claim 24, wherein a member in which said ejection outlets are provided and a member constituting said liquid passages are integrally formed, and the ejection outlets are formed by a laser beam.

26. An ink jet recording apparatus according to claim 24, wherein a member in which said ejection outlets are provided and said substrate are abutted to each other, positioned to each other and connected to each other.

27. An ink jet recording apparatus according to claim 24, wherein said first, said second and said third slanted surfaces are inclined relative to a plane of said substrate at a converging angle of 5–40 degrees.

28. An ink jet recording cartridge comprising:

an ink jet recording head for recording on a recording medium using an ink, said ink jet recording medium having;

a plurality of liquid passages terminating in respective ejection outlets, at respective longitudinal ends of said liquid passages, for ejection of the ink and each having an ejection energy generating means for generating ejection energy provided on a substrate, said liquid passages being approximately parallel to one another and being disposed in a plane;

a liquid chamber in fluid communication with said plurality of liquid passages, said liquid chamber containing the ink to be supplied to said liquid passages;

an inlet for supplying the ink to said liquid chamber, wherein said ejection outlets, said liquid passage and said liquid chamber are arranged in this order from one end of said ink jet recording head, and said liquid chamber having a first slanted inner surface extending from said inlet to said liquid passages, a second slanted inner surface and a third slanted inner surface extending from said inlet laterally with respect to a direction in which said passages extend and continuously from said first slanted surface, and having a region, disposed between said liquid passages and said first slanted portion, for suppressing movement of the bubble toward the liquid passages; and an ink container for containing the ink to be supplied to said inlet of said recording head.

29. An ink jet recording cartridge according to claim 28, wherein said ink container accommodates an ink absorbing material and is provided with a rib on its inner side.

30. An ink jet recording cartridge according to claim 28, wherein said first, said second and said third slanted surfaces are inclined relative to a plane of said substrate at a converging angle of 5–40 degrees.

* * * * *

UNITED STATES PATENT AND TRADEMARK OFFICE

CERTIFICATE OF CORRECTION

PATENT NO. : 6,113,223
DATED : September 5, 2000
INVENTOR(S) : Shigeaki Tanaka et al.

It is certified that error appears in the above-identified patent and that said Letters Patent is hereby corrected as shown below:

Column 1
Line 7, "07/798.981," should read -- 07/798,981, --;
Line 43, "not" should read -- does not --.

Column 3
Line 29, "can use" should read -- can --.

Column 5
Line 47, "bubble." should read -- bubbles. --;
Line 62, "three," should read -- in three --.

Column 6
Line 24, "Table," should read -- Table 1, --.

Column 7
Line 2, "A" should read -- An --;
Line 18, "in which" should read -- in which there are --;
Line 21, "110," should read -- 110 or --; and "101," should read -- 101 or --;
Line 31, "or" should read -- and --.

Column 8
Line 55, "is" should read -- which is --.

Column 9
Line 16, "FIGS. 2-4" should read -- FIGS. 2-4 of the --;
Line 20, "designates" should read -- designate --;
Line 36, "Figure," should read -- this Figure, --.

Column 10
Line 33, "symmetric" should read -- a symmetric --;
Line 43, "simple" should read -- a simple --.

UNITED STATES PATENT AND TRADEMARK OFFICE

CERTIFICATE OF CORRECTION

PATENT NO. : 6,113,223
DATED : September 5, 2000
INVENTOR(S) : Shigeaki Tanaka et al.

It is certified that error appears in the above-identified patent and that said Letters Patent is hereby corrected as shown below:

Column 13
Line 15, "to good" should read -- to have a good --;
Line 16, "is should read -- are --;
Line 29, "contacted to" should read -- contacting --;
Line 60, "an" should read -- of an --;
Line 61, "formed" should read -- are formed --.

Column 14
Line 40, "or the" should read -- or --.

Column 15
Line 14, "whole" should read -- hole --;
Line 19, "take" should read -- takes --;
Line 43, "whole" should read -- hole --;
Line 60, "is" should read -- assembling is --;
Line 61, "incoventional" should read -- in a conventional --.

Column 16
Line 9, "each" should read -- with each --;
Line 41, "decreases" should read -- decrease --;
Line 66, "whole" should read -- hole --.

Column 17
Line 28, "a" should be deleted.

Column 18
Line 7, "a the maxium" should read -- the maximum --;
Line 8, "provide" should read -- provided --;
Line 43, "a" (second occurrence) should be deleted;
Line 44, "head" should read -- heads --;
Line 62, "head" should read -- heads --;
Line 65, "color or density" should read -- colors and densities --.

Column 19
Line 55, "passages;" should read -- passages; and --.

UNITED STATES PATENT AND TRADEMARK OFFICE

CERTIFICATE OF CORRECTION

PATENT NO. : 6,113,223
DATED : September 5, 2000
INVENTOR(S) : Shigeaki Tanaka et al.

It is certified that error appears in the above-identified patent and that said Letters Patent is hereby corrected as shown below:

Column 20
Line 4, "toward" should read -- toward said liquid passages. --;
Line 5, "said liquid passages." should be deleted;
Line 36, "claim 6" should read -- claim 6, --.

Column 21
Line 15, "comprising;" should read -- comprising: --;
Line 18, "including;" should read -- including: --;
Line 29, "passages;" should read -- passages; and --.

Column 22
Line 13, "having" should read -- having: --;
Line 24, "passages;" should read -- passages; and --.

Signed and Sealed this

Eleventh Day of September, 2001

Nicholas P. Godici

*Attest:*

*Attesting Officer*

NICHOLAS P. GODICI
*Acting Director of the United States Patent and Trademark Office*